US006142788A

United States Patent [19]

Han

[11] Patent Number: 6,142,788

[45] Date of Patent: Nov. 7, 2000

[54] CABLE CONNECTOR AND MONITOR EQUIPPED WITH THE SAME

[75] Inventor: Sang-Hyun Han, Yongin, Rep. of Korea

[73] Assignee: SamSung Electronics Co., Ltd., Suwon, Rep. of Korea

[21] Appl. No.: 09/061,892

[22] Filed: Apr. 17, 1998

[30] Foreign Application Priority Data

| | | | |
|---|---|---|---|
| Apr. 17, 1997 | [KR] | Rep. of Korea | 97-8030 |
| Apr. 17, 1997 | [KR] | Rep. of Korea | 97-8031 |
| Apr. 17, 1997 | [KR] | Rep. of Korea | 97-8032 |
| May 31, 1997 | [KR] | Rep. of Korea | 97-13127 |

[51] Int. Cl.[7] ..... H01R 12/00

[52] U.S. Cl. ..... 439/63

[58] Field of Search ..... 439/82, 63, 581, 439/751, 873, 851

[56] References Cited

U.S. PATENT DOCUMENTS

| | | | |
|---|---|---|---|
| 2,910,525 | 10/1959 | Frank | 439/82 |
| 3,118,740 | 1/1964 | Cornell, Jr. | 439/851 |
| 3,366,920 | 1/1968 | Laudig et al. | 439/851 |
| 3,654,583 | 4/1972 | Mancini | 439/82 |
| 4,097,101 | 6/1978 | Holt et al. | 439/581 |
| 4,453,796 | 6/1984 | Monroe | 439/736 |
| 4,718,854 | 1/1988 | Capp et al. | 439/581 |
| 4,741,703 | 5/1988 | Jonescu et al. | 439/851 |
| 4,861,271 | 8/1989 | Bogar et al. | 439/736 |
| 4,995,819 | 2/1991 | Ohl | 439/82 |
| 5,495,395 | 2/1996 | Yoneda et al. | 439/82 |
| 5,733,133 | 3/1998 | Matsumura | 439/82 |
| 5,797,765 | 8/1998 | Barnett et al. | 439/63 |

*Primary Examiner*—Neil Abrams
*Assistant Examiner*—J. F. Duverne
*Attorney, Agent, or Firm*—Robert E. Bushnell, Esq.

[57] ABSTRACT

A cable connector 50 and a monitor 20 equipped with the same which is capable of decreasing the deformations of a connector 50 and a bracket 70 for fixing the connector 50 are disclosed, where the connector includes a housing sleeve 52 having an attachment unit securing the connector 50 to a printed circuit board 10 of the monitor 20, a pin 56 installed within a through hole of the housing sleeve 52 and fixed to the printed circuit board 10 and having end portions 56*b* and 58*b* which have a plurality of cuts in the radial direction for elastically contacting the printed circuit board 10, the pin 56 receiving electrical signals from the cable and then transmitting the electrical signals to the printed circuit board 10, and an insulation member 53 disposed between the pin 56 and the housing sleeve 52. The cable can include a coaxial 100 cable and the monitor 20 can include a computer monitor.

21 Claims, 10 Drawing Sheets

CABLE CONNECTOR AND MONITOR EQUIPPED WITH THE SAME

CLAIM OF PRIORITY

This application makes reference to, incorporates the same herein, and claims all benefits accruing under 35 U.S.C. §119 from four applications entitled CABLE CONNECTOR AND MONITOR EQUIPPED WITH THE SAME earlier filed in the Korean Industrial Property Office. Three of the four applications were filed in the Korean Industrial Property Office on Apr. 17, 1997, and there duly assigned respective Serial Numbers 1997-8030,1997-8031, and 1997-8032. The fourth application was filed in the Korean Industrial Property Office on May 31, 1997, and there duly assigned Serial Number 1997-13127. Copies of the four applications are annexed hereto.

BACKGROUND OF THE INVENTION

1. Technical Field

The present invention relates to a cable connector and a monitor equipped with the same, and more particularly to an improved cable connector and a monitor equipped with the same by which it is possible to transmit a signal from a cable to a printed circuit board.

2. Related Art

In a personal computer system, a signal cable is connected between a monitor and a computer main body conveying a video signal and a synchronizing signal from the computer main body to the monitor. A coaxial cable is generally used as the signal cable thereby transmitting stable signals and preventing electromagnetic waves in a stable manner. A coaxial cable is used for providing R, G and B signals, a vertical synchronizing signal, and a horizontal synchronizing signal between the computer main body and the monitor. A connector is used for connecting the cable between the computer main body and the monitor.

In one arrangement, there is the computer monitor having a cathode ray tube, a printed circuit board connected to the monitor for processing signals received from the computer main body, a bracket connected to the printed circuit board, a coaxial cable conveying signals to the printed circuit board from the computer main body, a socket fixed to one end of the coaxial cable, and a connector fitting into the socket. A first end of the connector is attached to a first end of the coaxial cable. A second end of the connector is placed partially in a hole in the bracket, then the connector is attached to the bracket. The connector has a housing sleeve, a threaded portion, a flat portion, and a pin having one end portion beveled. The shape of the hole in the bracket corresponds to the part of the connector that is placed into the hole. A washer and a nut are assembled over the threaded portion of the connector.

However, the connector includes the following problems. Namely, when using the bracket of the printed circuit board with a hole corresponding to the housing sleeve having a flat portion, the connector is not fixed in place in a stable manner. Thus, the connector can become movable. In addition, since a supporting force of the connector is applied to only a predetermined portion, the connector may be deformed due to an accumulated fatigue.

In addition, since one end portion of the pin of the connector is beveled, both ends of the same which are beveled may be widened, and a bur may occur therein, so that the cross section may become larger than the hole formed for receiving the pin. When that occurs, it is impossible to connect the connector in a stable manner. In addition, since only the outer portions of the pin are lead-welded, the connection is not implemented in a stable manner. For an easier assembling, the beveling must be precisely and accurately performed. When the beveling is precisely and accurately performed, the number of the processes need to be increased, and the fabrication costs increase.

Furthermore, when using the nuts and washers for assembling the connector, the number of elements is increased, and additional people may be required to assemble the connector. If a predetermined amount of force is applied to the nut during assembly, the threaded portion of the fixing portion may be damaged. Since the threaded portions are formed in the outer circumferential surface of the connector, the threading process is additionally required.

Accordingly, I have discovered that it would be desirable to develop an improved connector transmitting signals from a cable to a monitor, having a reduced fabrication cost, a reduced assembly cost, a reduced risk of damage during assembly, and an enhanced stability.

SUMMARY OF THE INVENTION

Thus, it is an object of the present invention to provide a cable connector and a monitor equipped with the same which overcome the aforementioned problems encountered in the related art.

It is another object of the present invention to provide a cable connector and a monitor equipped with the same which are capable of decreasing deformations of the connector and decreasing deformations of a bracket attached to the connector.

It is still another object of the present invention to provide a cable connector and a monitor equipped with the same which are capable of easily attaching a connector to a printed circuit board.

It is yet another object of the present invention to provide a connector having a predetermined portion for implementing a uniform lead-welding.

It is still another object of the present invention to provide a cable connector and a monitor equipped with the same with a reduced cost of assembly.

It is another object of the present invention to provide a cable connector and a monitor equipped with the same with a decreased number of components.

It is another object of the present invention to provide a cable connector and a monitor equipped with the same with a decreased number of people needed during assembly.

It is yet another object of the present invention to provide a cable connector and a monitor equipped with the same with a reduced risk of damage during assembly.

To achieve the above objects, there is provided an improved cable connector according to a first embodiment of the present invention which includes a housing sleeve having a member for fixing the connector to the printed circuit board and a through hole which passes through the housing sleeve in the axial direction. The improved cable connector also includes a pin installed within the through hole of the housing sleeve. The pin is fixed to the printed circuit board and has an end portion which is split twice in the radial direction. The improved cable connector also has an insulation member disposed between the pin and the housing sleeve. The pin transmits electrical signals to the printed circuit board.

To achieve the above objects, there is provided an improved cable connector according to a second embodiment of the present invention which includes a housing sleeve having a member for fixing the connector to the printed circuit board and a hole which passes through the housing sleeve in the axial direction. The improved cable connector also includes a pin installed within the through hole of the housing sleeve. A first end of the pin is fixed to the printed circuit board and transmits electrical signals to the printed circuit board. The first end of the pin is split twice in the radial direction. A second end of the pin is split twice in the radial direction then is outwardly bent. In this manner, the pin elastically contacts with a central conductor of the coaxial cable, and an insulation member disposed between the pin and the housing sleeve.

To achieve the above objects, there is provided an improved cable connector according to a third embodiment of the present invention which includes a housing sleeve having a protruding step portion comprised of a cylindrical plate attached on an outer circumferential surface of the housing sleeve. The diameter of the protruding step portion is larger than the diameter of a hole receiving the housing sleeve. The hole has a shape corresponding to the shape of the cross section of the housing sleeve. The housing sleeve is inserted into the hole until the protruding step portion is engaged. The outer surfaces are caulked fixing the housing sleeve. The housing sleeve has a through hole in a radial inner direction. The improved cable connector has a pin installed in the housing sleeve for transmitting an electrical signal to the printed circuit board. The pin is in contact with a central conductor of the cable. The improved cable connector has an insulation member installed between the pin and the housing sleeve.

To achieve the above objects, there is provided an improved monitor equipped with a connector according to the principles of the present invention which includes a coaxial cable for transmitting signals, a socket fixed to one end of the coaxial cable and having a groove formed in an outer circumferential surface of the socket, a printed circuit board for receiving and processing the signals from the coaxial cable, and a thin plate bracket fixed to the printed circuit board and having a hole of predetermined shape. There is also a housing sleeve having a connector fixing member for inserting into the hole formed in the bracket and thereby fixing the housing sleeve to the bracket. The housing sleeve additionally has a protrusion formed in an outer circumferential surface of the housing sleeve for attaching the housing sleeve to the socket. The protrusion of the housing sleeve is received into the groove of the socket. The housing sleeve also has a through hole axially passing through the housing sleeve. In addition, a pin installed in the through hole of the housing sleeve. The pin is fixed to the printed circuit board. A first end of the pin transmits an electrical signal from the cable to the printed circuit board and is split more than twice and is inwardly formed. There is an insulation member installed between the pin and the housing sleeve.

The aforementioned connector fixing member of the housing sleeve includes a threaded portion formed on an outer circumferential surface of the housing sleeve, and also includes a protruding step portion formed beside the threaded portion. The protruding step portion has a diameter larger than that of the threaded portion. The threaded portion of the housing sleeve includes spaced-apart flat portions. The threaded portion of the housing sleeve is inserted into the hole having the predetermined shape until the protruding step portion is engaged. The shape of the hole is the same shape as the cross-sectional shape of the housing sleeve. A the nut is assembled to the threaded portion to fix the housing sleeve to the hole in a stable manner. The protrusion formed on the housing sleeve is received by the groove formed in the socket of the cable for receiving the protrusion. The protrusion is inserted into the groove thus fixing the socket to the housing sleeve. The cable is provided to transmit R, G, and B signals, a vertical synchronous signal, or a horizontal synchronous signal.

A first end of the pin of the connector according to the principles of the present invention is split more than twice and then outwardly bent, so that the pin elastically contacts with a central conductor of the coaxial cable. Alternatively, a first end of a pin of a conventional connector is split only once. One of the problems of the conventional connector is that an elastic force is small, so that the connection between the central conductor of the coaxial cable and the pin is not stable. In the present invention, the first end portion of the pin is split more than twice, thus enhancing an elastic force of the pin and implementing a stable connection between the pin and the central conductor.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
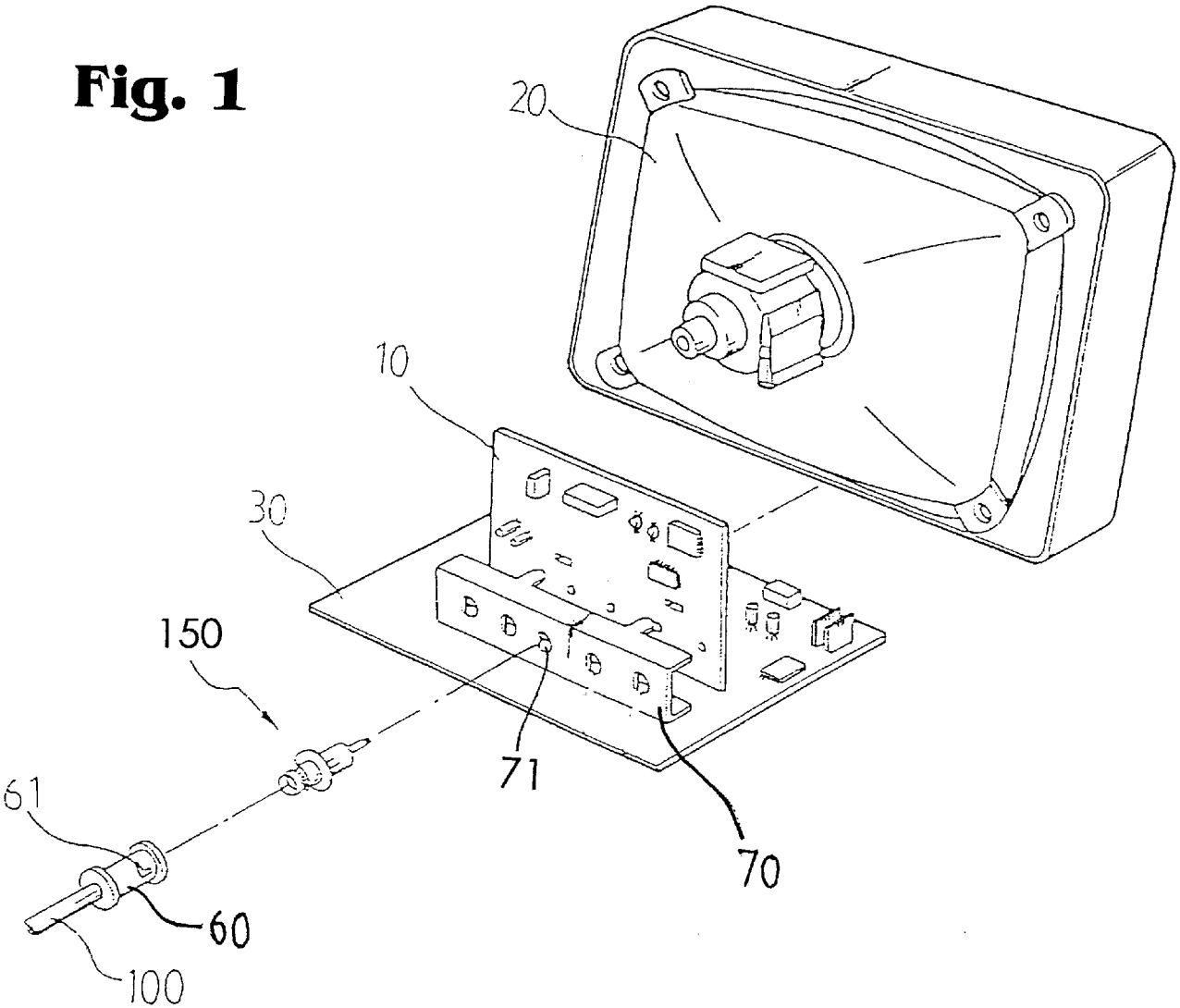
FIG. 1 is an exploded view illustrating a connector installed in a monitor.

Referring now to FIG. 1, which is an exploded view illustrating a connector installed in a monitor, there is depicted a front portion of a monitor having a cathode-ray tube 20. Additionally, there are depicted a printed circuit board (PCB) 10 for processing the signals received through a coaxial cable 100, a main printed circuit board 30 having the printed circuit board 10, a socket 60 secured to one end of the coaxial cable 100, a first end of a connector 150 to be received into the socket 60, and a thin plate bracket 70 connected to the main printed circuit board 30. The bracket 70 has a plurality of individual holes. Each hole forms an opening through the bracket 70. A second end of the connector 150 is to be received into a hole 71. The connector 50 is to be inserted into the hole 71 and then secured to the bracket 70. In addition, there is a groove 61 formed in the socket 60.

Figure 2:
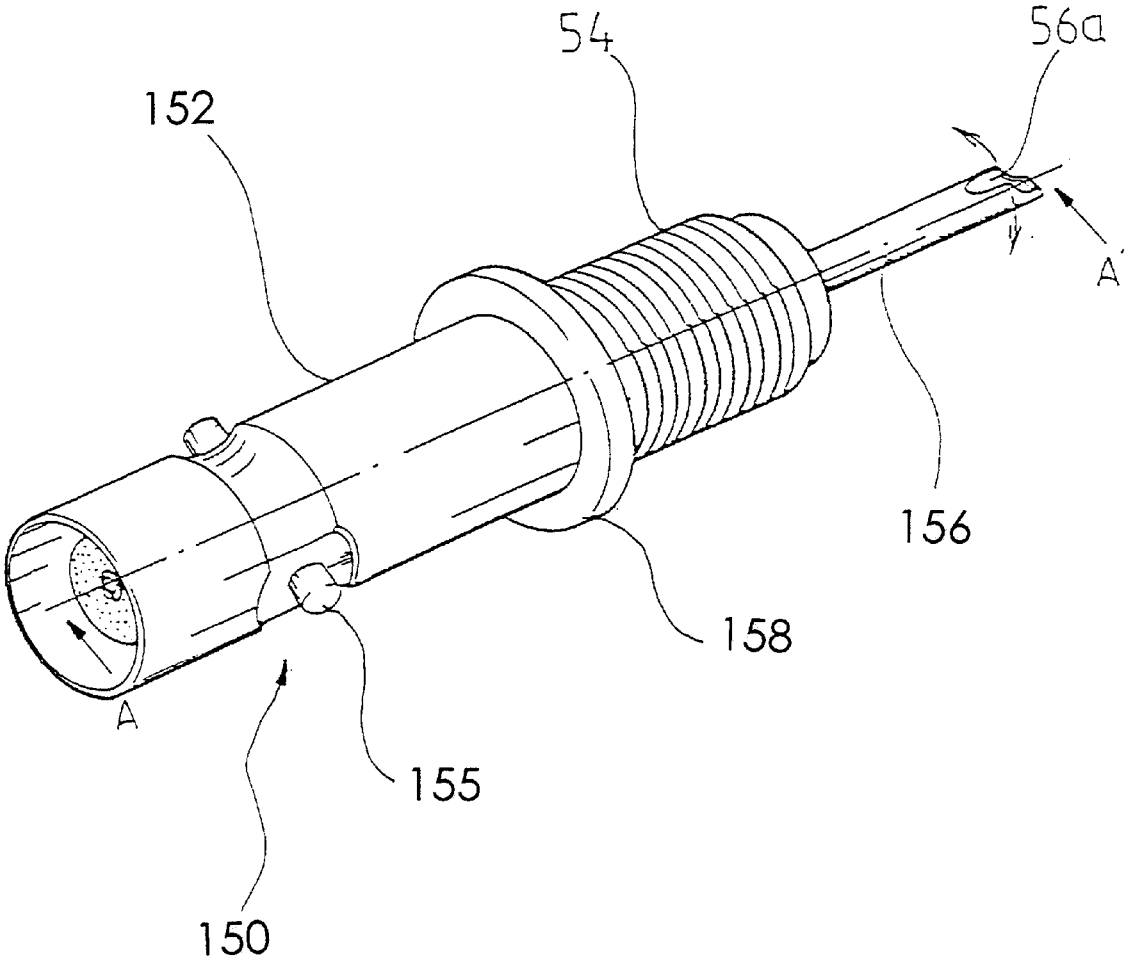
FIG. 2 is a perspective view illustrating a connector.

With continued reference to FIG. 1, refer now to FIG. 2, which is a perspective view illustrating a connector. At one end of the connector 150 there is a pin 156 extended from a housing sleeve 152 of the connector 150. The pin 156 is to be connected with the printed circuit board 10. A threaded portion 54 is formed in the front portion of the housing sleeve 152 and is to be engaged with a nut. A protruding step portion 158 having a diameter larger than that of the thin plate bracket 70 is formed behind the threaded portion 54. A protrusion 155 is formed beside the housing sleeve 152 and is to be engaged with the groove 61 of the socket 60. An end portion 56*a* of pin 156 is beveled.

Figure 3A:
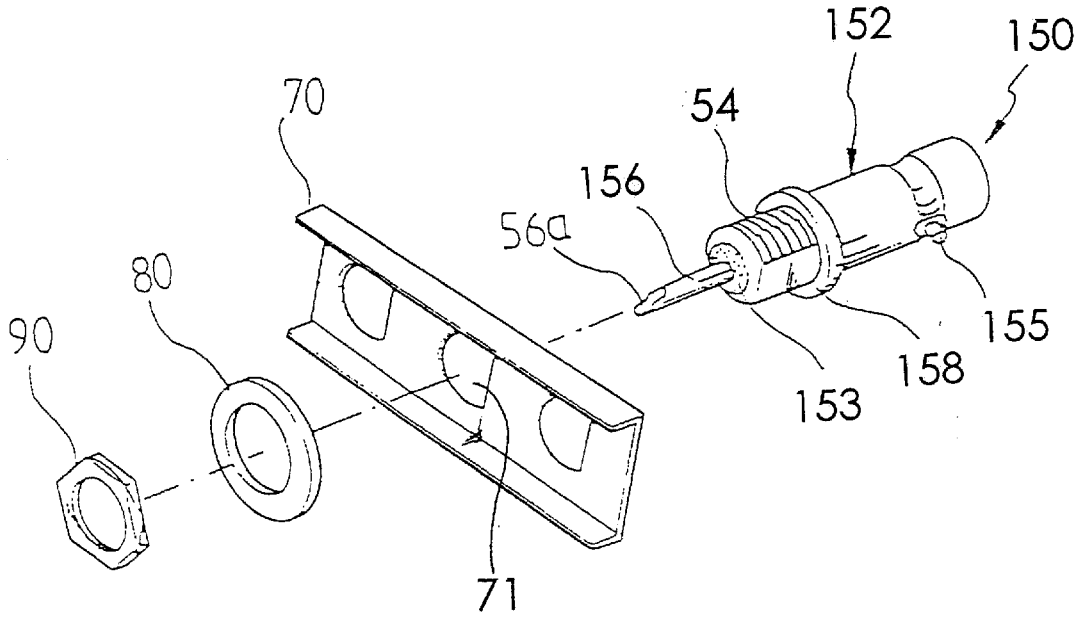
FIG. 3A is an exploded perspective view illustrating components of the connector of FIG. 2.

Refer now to FIG. 3A, which is an exploded perspective view illustrating components of the connector of FIG. 2. There is a connector 150 and a thin plate bracket 70. A threaded portion 54 has a flat portion, and a hole 71 formed in the bracket 70 has the same shape as the cross-sectional shape of the threaded portion 54, so that the connector 150 is engaged within the hole 71 when inserting the threaded portion 54 into the hole 71. Thereafter, a washer 80 and a nut 90 are assembled, thus securing the connector 150. There is a housing sleeve 152, a protrusion 155, a protruding step portion 158, and a pin 156. The end portion 56*a* of the pin 156 is shown. The end portion 56*a* is beveled. An insulation member 153 is formed between the pin 156 and the housing sleeve 152.

Figure 3B:
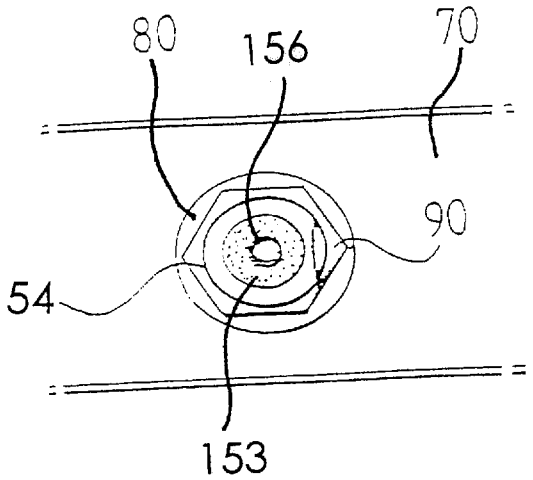
FIG. 3B is an end view illustrating the connector of FIG. 2 assembled onto a bracket.

Refer now to FIG. 3B, which is an end view illustrating the connector of FIG. 2 assembled onto a bracket. A pin 156, an insulating member 53, a threaded portion 54, washer 80, nut 90, and bracket 70 are each depicted. The components are shown as they would appear if viewed from the position of the printed circuit board 10.

Figure 4:
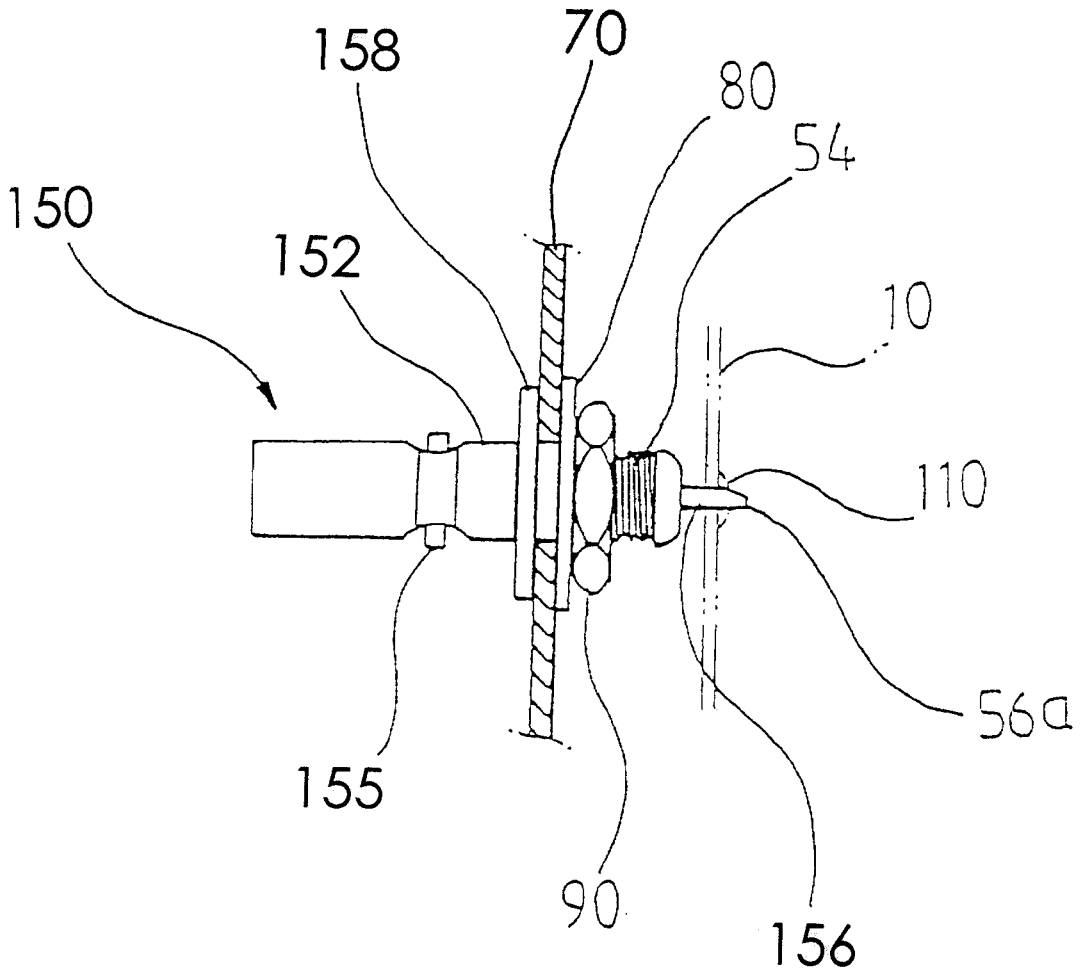
FIG. 4 is a schematic view illustrating the connector of FIG. 2 assembled onto a bracket, with a pin of the connector being connected with a printed circuit board.

Refer now to FIG. 4, which is a schematic view illustrating the connector of FIG. 2 assembled onto a bracket, with a pin of the connector being connected with a printed circuit board. A connector 150, pin 156, threaded portion 54, washer 80, nut 90, and bracket 70 are depicted. In addition, a housing sleeve 152, protruding step portion 158, protrusion 155, and a beveled end portion 56*a* of the pin 156 are each depicted. There is a printed circuit board 10 secured to the pin 156 with a fixing member 110.

The cable connector and a monitor equipped with the same according to the principles of the present invention will be explained with reference to the accompanying drawings.

Figure 5:
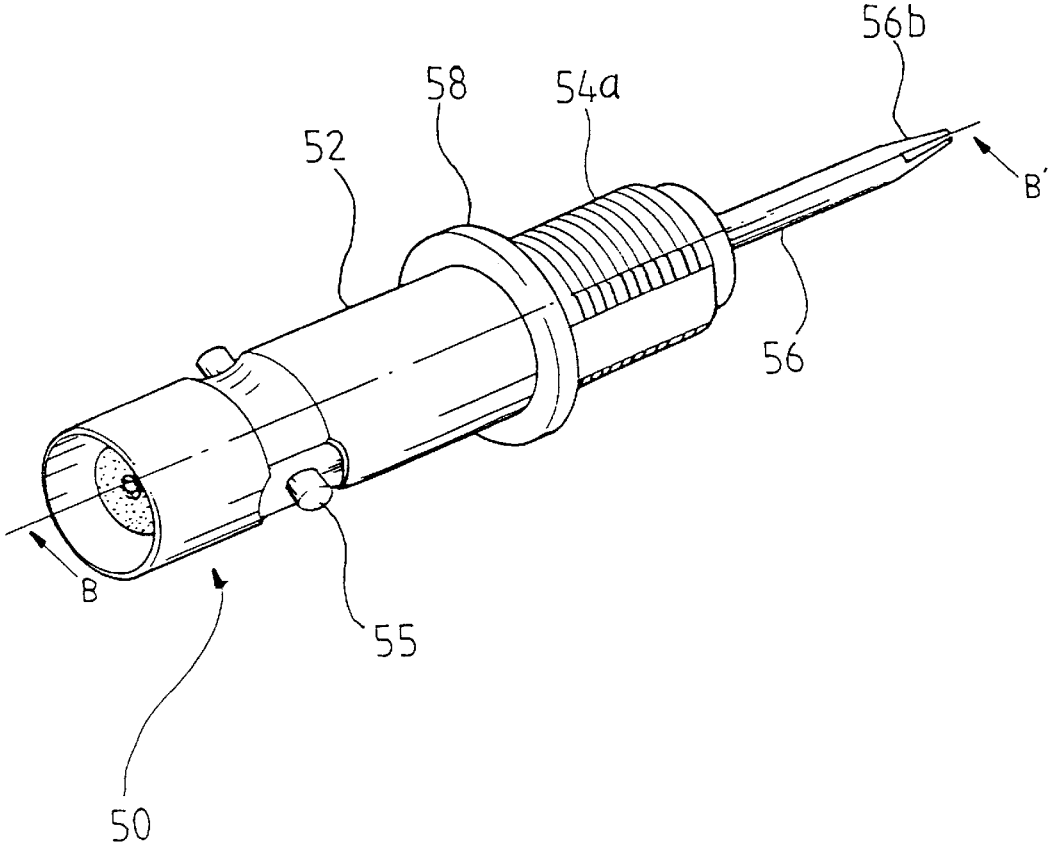
FIG. 5 is a perspective view illustrating a first embodiment of a connector, according to the principles of the present invention.

Refer now to FIG. 5, which is a perspective view illustrating a first embodiment of a connector, according to the principles of the present invention. There is a connector 50, a protrusion 55, a housing sleeve 52, a protruding step portion 58, and a pin 56 with an end portion 56*b*. The pin 56 is to be connected to a printed circuit board. The protrusion 55 to be connected with a socket of a cable. The protruding step portion 58 has a diameter larger than the outer diameter of the housing sleeve 52. A threaded portion 54*a* is formed adjacent to the pin 56. The protruding step portion 58 is formed adjacent to the threaded portion 54*a*. The end portion 56*b* of the pin 56 is radially split twice and is radially inwardly bent. The threaded portion 54*a* includes spaced-apart flat portions.

Figure 6:
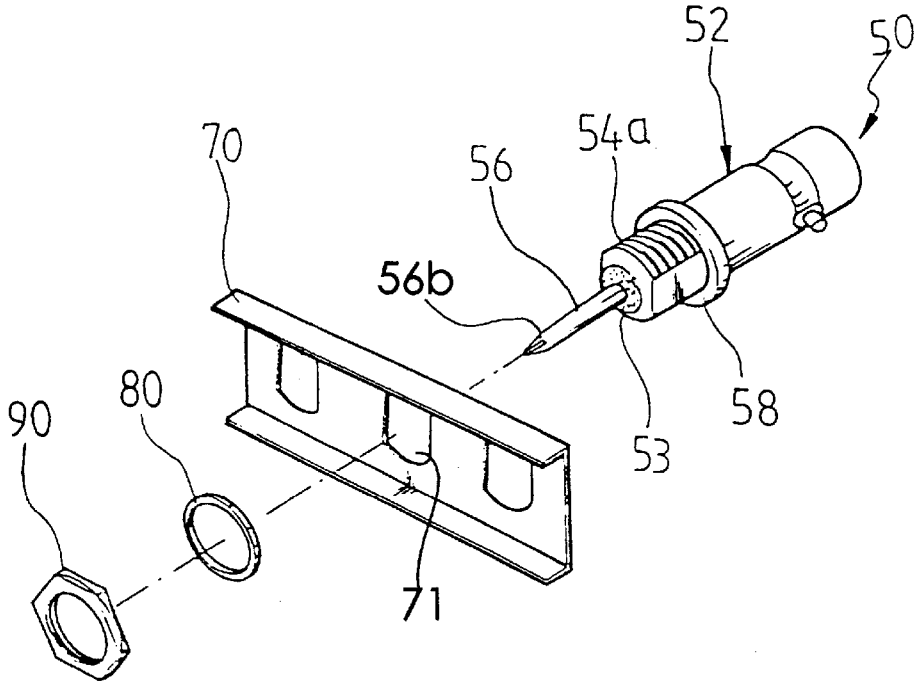
FIG. 6 is an exploded perspective view illustrating components of the connector of FIG. 5, according to the principles of the present invention.

Refer now to FIG. 6, which is an exploded perspective view illustrating components of the connector of FIG. 5, according to the principles of the present invention. There is a bracket 70 having a hole 71. The shape of the hole 71 corresponds to the cross-sectional shape of the connector 50. A threaded portion 54*a* of the connector 50 is inserted into the hole 71 of the bracket 70, and then a washer 80 and a nut 90 are assembled over the threaded portion 54*a*, thus securing the connector 50 to the bracket 70. An insulation member 53 is formed between the pin 56 and the housing sleeve 52, so that an electrical signal applied to the pin 56 is prevented from being transmitted to the housing sleeve 52 and the bracket 70. There is a protruding step portion 58. An end portion 56*b* of the pin 56 is depicted.

Figure 7:
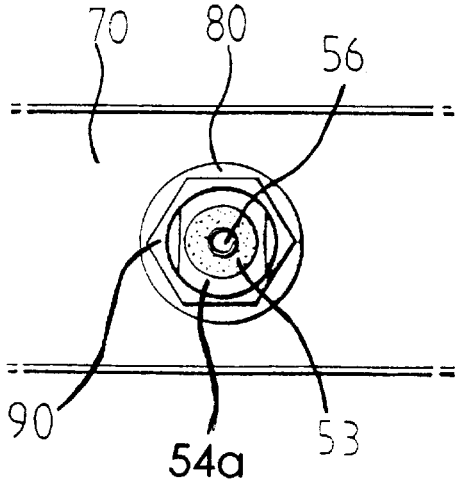
FIG. 7 is an end view illustrating the connector of FIG. 5 assembled onto a bracket, according to the principles of the present invention.

Refer now to FIG. 7, which is an end view illustrating the connector of FIG. 5 assembled onto a bracket, according to the principles of the present invention. There is a bracket 70, washer 80, nut 90, pin 56, insulation member 53, and a threaded portion 54*a*. The components are shown as they would appear if viewed from the position of the printed circuit board 10.

Figure 8A:
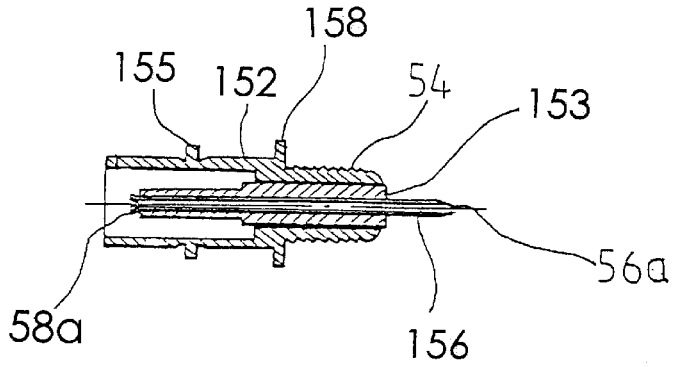
FIG. 8A is a longitudinal cross-sectional view illustrating the connector of FIG. 2.

Refer now to FIG. 8A, which is a longitudinal cross-sectional view illustrating the connector of FIG. 2. A first end portion 56*a* of a pin 156 of FIG. 8A corresponds to the pin 156 connected to the printed circuit board 10 of FIG. 4. A second end portion 58*a* of pin 156 of FIG. 8A is to be connected with a central conductor of the coaxial cable 100 of FIG. 1. There is an insulating member 153, protruding step portion 158, housing sleeve 152, threaded portion 54, and a protrusion 155. The end portion 56*a* is beveled.

Figure 8C:
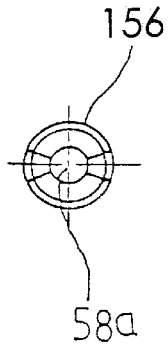
FIG. 8C is an end view illustrating a pin installed in the connector of FIG. 2.
Figure 8B:
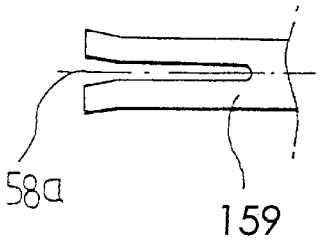
FIG. 8B is an enlarged view illustrating an end portion of a pin installed in the connector of FIG. 2.

Refer now to FIG. 8B, which is an enlarged view illustrating an end portion of a pin installed in the connector of FIG. 2. With reference to pin 156 of FIGS. 2 and 8A, an end region 159 of the pin 156 is depicted. Also, an end portion 58*a* of the pin 156 is depicted. The end portion 58*a* is the end of the pin 156 of FIG. 8A which is to be connected with a central conductor of the coaxial cable 100 of FIG. 1. The end portion 58*a* of the pin 156 is radially split once. The central conductor of the cable 100 of FIG. 1 elastically contacts with the split end portion 58*a* of the pin 156. When the end portion 58*a* is radially split once as shown in FIGS. 8A and 8B, a predetermined elastic force may not be generated. The absence of this predetermined elastic force is an important problem with the connector of FIG. 2.

Refer now to FIG. 8C, which is an end view illustrating a pin installed in the connector of FIG. 2. There is an end portion 58*a* of a pin 156. The end portion 58*a* of the pin 56 is radially split once. When the end portion 58*a* is radially split once as shown in FIGS. 8A through 8C, a predetermined elastic force may not be generated. The absence of this predetermined elastic force is an important problem with the connector of FIG. 2.

Figure 9A:
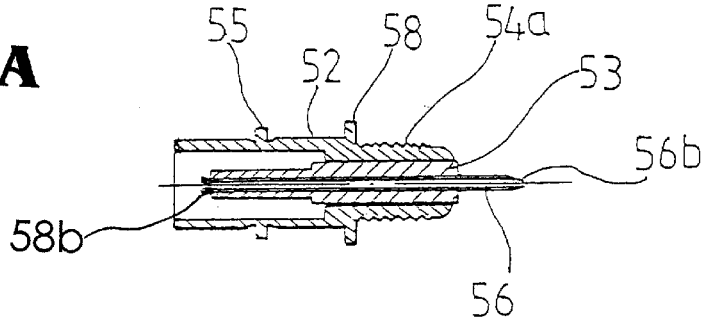
FIG. 9A is a longitudinal cross-sectional view illustrating the connector of FIG. 5, according to the principles of the present invention.

Refer now to FIG. 9A, which is a longitudinal cross-sectional view illustrating the connector of FIG. 5, according to the principles of the present invention. A first end portion 56*b* of a pin 56 of FIG. 9A is to be connected to a printed circuit board. A second end portion 58*b* of pin 56 of FIG. 9A is to be connected with a central conductor of the coaxial cable 100 of FIG. 1. There is an insulating member 53, protruding step portion 58, housing sleeve 52, threaded portion 54*a*, a protrusion 55. The end portion 56*b* of the pin 56 is radially split twice and is radially inwardly bent.

The connector depicted 50 in FIG. 9A solves a problem of the connector 150 depicted in FIGS. 8A, 8B, and 8C. More particularly, the end portion 58*b* of FIG. 9A is radially split twice, whereas the end portion 58*a* of FIG. 8A is radially split only once.

In FIG. 9A, the end portion 58*b* of the pin 56 is the end that is to be in contact with the central conductor of the coaxial cable 100 of FIG. 1. The end portion 58*b* is radially split twice, so that it is possible to implement a stable connection between the coaxial cable 100 and the split end portion 58*b*. In addition, since the end portions 56*b* and 58*b* of the pin 56 are bent at predetermined angles, it is possible to provide a stable predetermined elastic force.

Figure 9C:
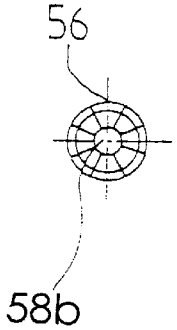
FIG. 9C is an end view illustrating a pin installed in the connector of FIG. 5, according to the principles of the present invention.
Figure 9B:
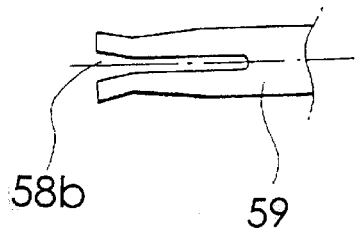
FIG. 9B is an enlarged view illustrating an end portion of a pin installed in the connector of FIG. 5, according to the principles of the present invention.

Refer now to FIG. 9B, which is an enlarged view illustrating an end portion of a pin installed in the connector of FIG. 5, according to the principles of the present invention. With reference to pin 56 of FIG. 9A, an end region 59 is depicted. Also, an end portion 58*b* of the pin 56 is depicted. The end portion 58*b* is the end of the pin 56 of FIG. 9A which is to be connected with a central conductor of the coaxial cable 100 of FIG. 1. The end portion 58*b* of the pin 56 is radially split twice. The central conductor of the coaxial cable 100 of FIG. 1 elastically contacts with the split end portion 58*b* of the pin 56. When the end portion 58*b* is radially split twice as shown in FIGS. 9A and 9B, a predetermined elastic force may be generated, thereby solving a problem of the connector 150 depicted in FIGS. 8A, 8B, and 8C.

It is important to note that the elastic force that may be generated using end portion 58*b* of FIG. 9B is greater than the elastic force that may be generated using end portion 58*a* of FIG. 8B.

Refer now to FIG. 9C, which is an end view illustrating a pin installed in the connector of FIG. 5, according to the principles of the present invention. There is an end portion 58*b* of a pin 56. The end portion 58*b* of the pin 56 is radially split twice. When the end portion 58*b* is radially split twice as shown in FIGS. 9A, 9B, and 9C, a predetermined elastic force may be generated. This predetermined elastic force is important.

Figure 10:
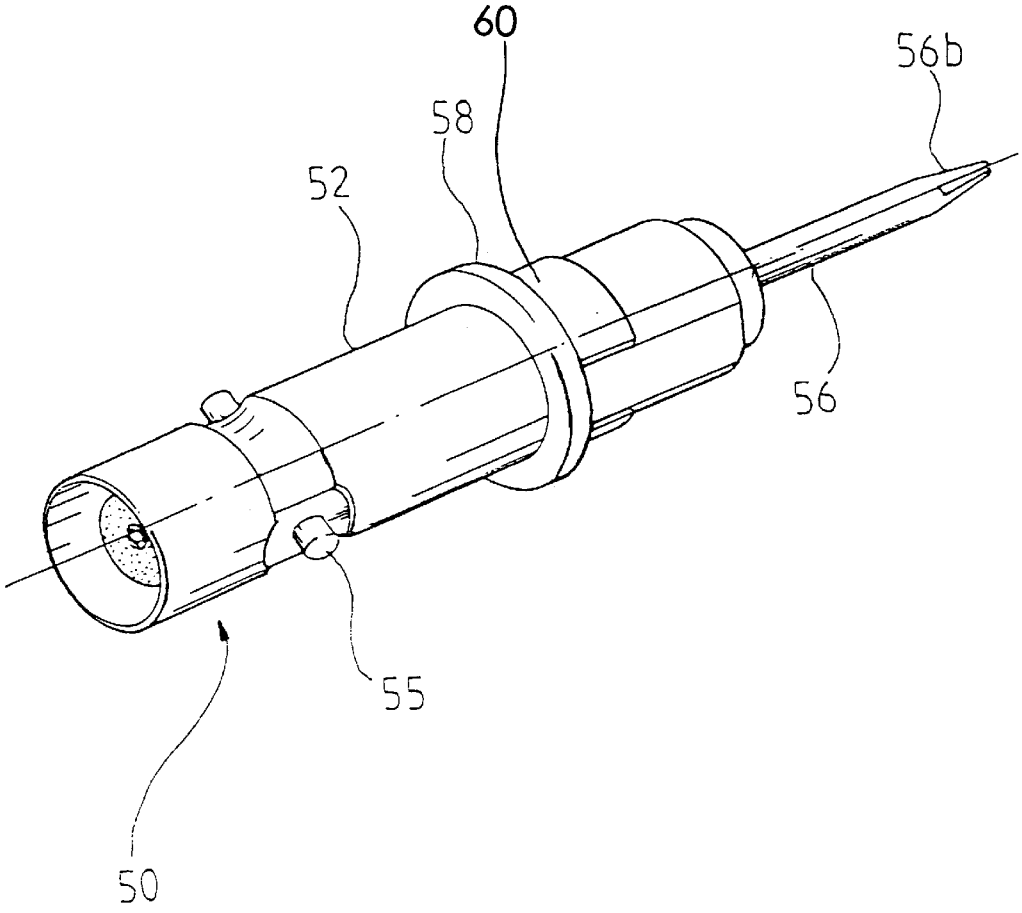
FIG. 10 is a perspective view illustrating a second embodiment of a connector, according to the principles of the present invention.

Refer now to FIG. 10, which is a perspective view illustrating a second embodiment of a connector, according to the principles of the present invention. There is a connector 50 having a pin 56 with an end portion 56*b*. The end portion 56*b* of the pin 56 is radially split twice and is radially inwardly bent. There is a housing sleeve 52, protrusion 55, and a protruding step portion 58. A cylindrical plate 60 surrounds part of the housing sleeve 52 and is extended from the protruding step portion 58 in the direction of the end portion 56*b*. There is no threaded portion. The connector 50 of FIG. 10 can be secured to the bracket 70 and the hole 71 of FIG. 6 by applying caulk to the region of the cylindrical plate 60 when the protruding step portion 58 is in contact with the bracket 70 while the cylindrical plate 60 penetrates the hole 71. When the cylindrical portion 60 is caulked in order to secure the connector 50 to the bracket 70, no washer is needed, no nut is needed, and no threaded portion is needed. The number of processes is decreased when the connector of FIG. 10 is produced, resulting in low fabrication cost.

Figure 11:
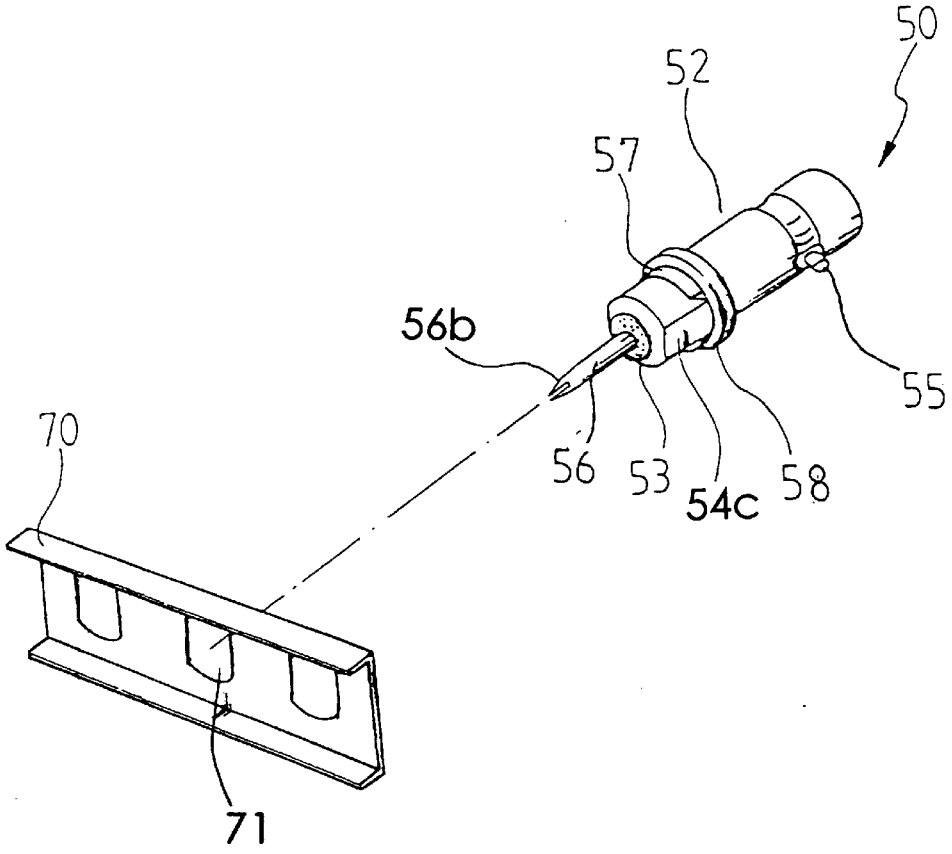
FIG. 11 is a perspective view illustrating a third embodiment of a connector, aligned in order to be engaged with a bracket, according to the principles of the present invention.

Refer now to FIG. 11, which is a perspective view illustrating a third embodiment of a connector, aligned in order to be engaged with a bracket, according to the principles of the present invention. There is a connector 50, a protrusion 55, a housing sleeve 52, a pin 56, an end portion 56*b* of the pin 56, an insulating member 53, a bracket 70, a hole 71, and a protruding step portion 58. In addition, a first clip unit 57 is extended from the protruding step portion 58. There is a second clip unit 54*c* which engages an edge of the hole 71 when the connector 50 is assembled with the bracket 70. A caulking process can be used to further secure the connector 50 to the bracket 70.

Figure 12:
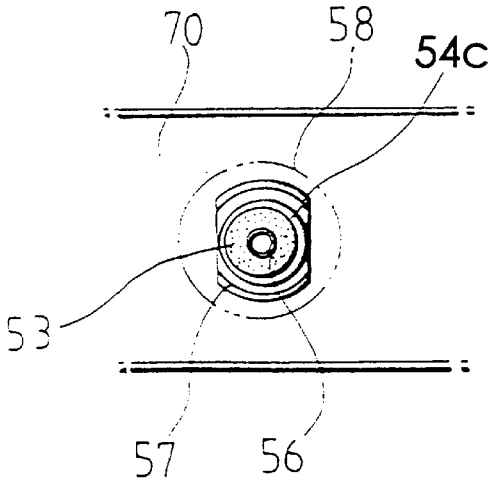
FIG. 12 is an end view illustrating the connector of FIG. 11 engaged with a bracket, according to the principles of the present invention.

Refer now to FIG. 12, which is an end view illustrating the connector of FIG. 11 engaged with a bracket, according to the principles of the present invention. There is a bracket 70, an insulating member 53, a pin 56, and a protruding step portion 58. There is also a first clip unit 57 and a second clip unit 54*c* fixing the connector 50 to the bracket 70.

Figure 13:
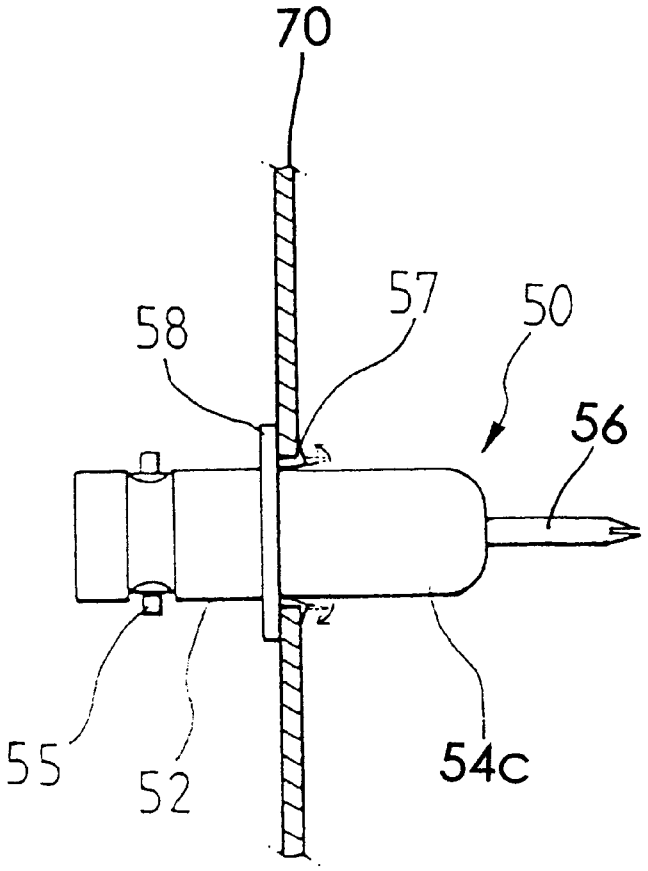
FIG. 13 is a schematic view illustrating a fourth embodiment of a connector and a method for securing the connector to a bracket, according to the principles of the present invention.

Refer now to FIG. 13, which is a schematic view illustrating a fourth embodiment of a connector and a method for securing the connector to a bracket, according to the principles of the present invention. There is a connector 50, a bracket 70, a protruding step portion 58, a protrusion 55, a housing sleeve 52, and a pin 56. There is also a frontal portion 54*c* penetrating the bracket 70. In addition, there is a clip portion 57 securing the connector 50 to the bracket 70.

As described above, it is possible to stably connect a coaxial cable with a printed circuit board using a connector according to the principles of the present invention. In addition, any damages of the connector bracket due to a torsion or the like are prevented due to the increase in the elastic forces associated with the present invention. Also, since fewer components are needed, the assembly cost can be decreased. Additionally, the number of people required to be involved in fabrication, assembly, testing, maintenance, and quality control can be decreased.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An electrical connector connecting a cable to a printed circuit board, said connector comprising:

a connector body, comprising:

a first end and a second end, said connector body having a hole through said connector body along a substantially straight line formed between said first and second ends, said first end receiving a cable; and a holding unit protruding from a surface of said connector body at a location on said connector body adjacent to said first end of said connector body, said holding unit engaging a groove located on a socket attached to the cable thereby stably securing said connector body to the cable;

an electrically conductive pin being disposed partly within the hole of said connector body, said pin being substantially straight, said pin comprising:

a first pin end having a first plurality of radial cuts dividing said first pin end into a first plurality of portions, said first plurality of portions being bent outwardly from longitudinal axis of said pin, said first pin end elastically contacting a conductor of the cable, said first pin end receiving an electrical signal from the conductor of the cable; and a second pin end having a second plurality of radial cuts dividing said second pin end into a second plurality of portions, said second plurality of portions being bent inwardly toward longitudinal axis of said pin, said second pin end elastically contacting said printed circuit board and conveying to a printed circuit board said signal received from the cable;

an attachment unit secured to said connector body attaching said connector body to said printed circuit board.

2. The electrical connector of claim 1, wherein said first plurality of radial cuts corresponds to more than two radial cuts, said first plurality of portions corresponds to more than four portions, said second plurality of radial cuts corresponds to more than two radial cuts, and said second plurality of portions corresponds to more than four portions.

3. The electrical connector of claim 1, wherein said first plurality of radial cuts corresponds to more than two radial cuts and said second plurality of radial cuts corresponds to more than two radial cuts.

4. The electrical connector of claim 3, wherein said pin further comprises:

a first section of said pin being adjacent to said first end of said pin and being disposed wholly within the hole defined by said connector body; and a second section of said pin being located between said first section of said pin and said second end of said pin, said second section of said pin extending beyond said second end of said connector body.

5. The electrical connector of claim 4, wherein said attachment unit comprises:

a threaded unit formed on a surface of said connector body, disposed between said first and second ends of said connector body, having an external screw thread, having a first diameter, and having an external surface forming a first shape; and a blocking unit protruding from said surface of said connector body, said blocking unit being disposed between said threaded unit and said first end of said connector body, said blocking unit having a second diameter larger than said first diameter, and said blocking unit engaging a support unit attached to said printed circuit board.

6. The electrical connector of claim 5, wherein said threaded unit further comprises a plurality of spaced-apart flat sections not having said external screw thread, said second end of said connector body and said threaded unit being received into an aperture of the support unit until said blocking unit engages the support unit, the aperture having a third diameter being larger than said first diameter and smaller than said second diameter, the aperture having a second shape corresponding to said first shape, and said threaded unit receiving and engaging a perforated block having an internal screw thread thereby stably securing said connector body to said printed circuit board.

7. The electrical connector of claim 4, wherein said attachment unit comprises:

a blocking unit protruding from a surface of said connector body between said first and second ends of said connector body, and having a first diameter; and a receiving unit extending from said blocking unit over said surface of said connector body toward said second end of said connector body, having a second diameter smaller than said first diameter, and having an external surface forming a first shape, said second end of said connector body and said receiving unit being received into an aperture of a support unit attached to said printed circuit board until said blocking unit engages the support unit, the aperture having a third diameter being larger than said second diameter and smaller than said first diameter, the aperture having a second shape corresponding to said first shape, said blocking unit engaging the support unit, and the support unit and said receiving unit being caulked together thereby stably securing said connector body to said printed circuit board.

8. The electrical connector of claim 4, wherein said attachment unit comprises:

a blocking unit protruding from a surface of said connector body between said first and second ends of said connector body, and having a first diameter; and a flexible clip unit extending from said blocking unit over said surface of said connector body toward said second end of said connector body, having a minimum clip diameter smaller than said first diameter, and having an external surface forming a first shape, said second end of said connector body and said receiving unit being received into an aperture of a support unit attached to said printed circuit board until said blocking unit engages the support unit, the aperture having a third diameter being larger than said minimum clip diameter and smaller than said first diameter, the aperture having a second shape corresponding to said first shape, said blocking unit receiving the support unit, and said flexible clip unit flexing away from said connector body engaging and locking in place the support unit thereby stably securing said connector body to said printed circuit board.

9. The electrical connector of claim 2, further comprising an insulating unit being disposed between said pin and said connector body.

10. An electrical connector connecting a cable to a printed circuit board, said connector comprising:

a hollow cylindrical body having a first end and a second end, said cylindrical body defining a hole through said cylindrical body along a line formed between said first and second ends, said first end receiving a cable;

an electrically conductive pin being disposed partly within the hole of said cylindrical body, said pin comprising:

a first pin end having a first plurality of radial cuts dividing said first pin end into a first plurality of portions, said first plurality of portions being bent outwardly from longitudinal axis of said pin, said first pin end elastically contacting a conductor of the cable, said first pin end receiving an electrical signal from the conductor of the cable; and a second pin end elastically contacting said printed circuit board and conveying to said printed circuit board said signal received from the cable;

an attachment unit being secured to said cylindrical body attaching said cylindrical body to a printed circuit board.

11. The electrical connector of claim 10, further comprising:

said second pin end having a second plurality of radial cuts dividing said second pin end into a second plurality of portions, said second plurality of portions being bent inwardly toward longitudinal axis of said pin; and a holding unit protruding from a surface of said cylindrical body at a location on said cylindrical body adjacent to said first end of said cylindrical body, said holding unit engaging a groove located on a socket attached to the cable thereby securing said cylindrical body to the cable.

12. The electrical connector of claim 11, wherein said pin further comprises:

a first section of said pin being adjacent to said first end of said pin and being disposed wholly within the hole defined by said cylindrical body; and a second section of said pin being located between said first section of said pin and said second end of said pin, said second section of said pin extending beyond said second end of said cylindrical body.

13. The electrical connector of claim 10, wherein said attachment unit comprises:

a threaded unit formed on a surface of said cylindrical body, disposed between said first and second ends of said cylindrical body, having an external screw thread, having a first diameter, and having an external surface forming a first shape; and a blocking unit protruding from said surface of said cylindrical body, said blocking unit being disposed between said threaded unit and said first end of said cylindrical body, said blocking unit having a second diameter larger than said first diameter, and said blocking unit engaging a support unit attached to said printed circuit board.

14. The electrical connector of claim 13, wherein said threaded unit further comprises a plurality of spaced-apart flat sections not having said external screw thread, said second end of said cylindrical body and said threaded unit being received into an aperture of the support unit until said blocking unit engages the support unit, the aperture having a third diameter being larger than said first diameter and smaller than said second diameter, the aperture having a second shape corresponding to said first shape, and said threaded unit receiving and engaging a perforated block having an internal screw thread thereby stably securing said cylindrical body to said printed circuit board.

15. The electrical connector of claim 12, wherein said attachment unit comprises:

a blocking unit protruding from a surface of said cylindrical body between said first and second ends of said cylindrical body, and having a first diameter; and a receiving unit extending from said blocking unit over said surface of said cylindrical body toward said second end of said cylindrical body, having a second diameter smaller than said first diameter, and having an external surface forming a first shape, said second end of said cylindrical body and said receiving unit being received into an aperture of a support unit attached to said printed circuit board until said blocking unit engages the support unit, the aperture having a third diameter being larger than said second diameter and smaller than said first diameter, the aperture having a second shape corresponding to said first shape, said blocking unit engaging the support unit, and the support unit and said receiving unit being caulked together thereby stably securing said cylindrical body to said printed circuit board.

16. The electrical connector of claim 10, wherein said attachment unit comprises:

a blocking unit protruding from a surface of said cylindrical body between said first and second ends of said cylindrical body, and having a first diameter; and a flexible clip unit extending from said blocking unit over said surface of said cylindrical body toward said second end of said cylindrical body, having a minimum clip diameter smaller than said first diameter, and having an external surface forming a first shape, said second end of said cylindrical body and said receiving unit being received into an aperture of a support unit attached to said printed circuit board until said blocking unit engages the support unit, the aperture having a third diameter being larger than said minimum clip diameter and smaller than said first diameter, the aperture having a second shape corresponding to said first shape, said blocking unit receiving the support unit, and said flexible clip unit flexing away from said cylindrical body engaging and locking in place the support unit thereby stably securing said cylindrical body to said printed circuit board.

17. The electrical connector of claim 15, further comprising an insulating unit being disposed between said pin and said connector body.

18. An electrical connector, comprising:

a coaxial cable transmitting electrical signals, said cable having a first end and a second end, said first end being connected to a video display unit conveying varying visual information to a user;

a socket being secured to said first end of said cable, having a groove formed in an outer circumferential surface of said socket;

a printed circuit board being connected to the video display unit receiving and processing said signals from said cable;

a support unit being secured to said printed circuit board, defining a predetermined aperture of a first shape;

a connector body having a first end, a second end, and a holding unit, said connector body defining a hole through said connector body along a substantially straight line formed to connect said first and second ends, said holding unit protruding from a surface of said connector body at a location on said connector body adjacent to said first end of said connector body, said holding unit engaging the groove of said socket thereby securing said connector body to said cable;

an electrically conductive pin being disposed partly within the hole of said connector body, said pin being substantially straight said pin comprising:

a first pin end having a first plurality of radial cuts dividing said first pin end into a first plurality of portions, said first plurality of portions being bent outwardly from longitudinal axis of said pin, said first pin end elastically contacting a conductor of the cable, said first pin end receiving an electrical signal from the conductor of the cable; and a second pin end having a second plurality of radial cuts dividing said second pin end into a second plurality of portions, said second plurality of portions being bent inwardly toward longitudinal axis of said pin, said second pin end elastically contacting said printed circuit board conveying to said printed circuit board said signal received from the cable;

an insulating unit disposed between said pin and said connector body; and an attachment unit being secured to said connector body attaching said connector body to said support unit, having a second shape corresponding to said first shape of the aperture of said support unit, being received into the aperture of said support unit.

19. The electrical connector of claim 18, wherein said electrical signals include a video signal, a horizontal synchronization signal and a vertical synchronization signal.

20. The electrical connector of claim 18, wherein said attachment unit comprises:

a blocking unit protruding from a surface of said connector body between said first and second ends of said connector body, and having a first diameter; and a receiving unit extending from said blocking unit over said surface of said connector body toward said second end of said connector body, having a second diameter smaller than said first diameter, and having an external surface forming a first shape, said second end of said connector body and said receiving unit being received into the aperture of said support unit until said blocking unit engages said support unit, the aperture having a third diameter being larger than said second diameter and smaller than said first diameter, said blocking unit engaging said support unit, and said support unit and said receiving unit being caulked together thereby stably securing said connector body to said printed circuit board.

21. A coaxial cable connector connecting a cable to a printed circuit board, said connector comprising:

a hollow cylindrical body having a first end and a second end, said cylindrical body defining a center hole through said cylindrical body along a line formed between said first and second ends, said first end receiving a coaxial cable;

an electrically conductive pin disposed partly within the hole of said cylindrical body having a first pin end having a first plurality of radial cuts dividing said first pin end into a first plurality of portions, said first plurality of portions being bent outwardly from longitudinal axis of said pin, said first pin end elastically contacting a conductor of the coaxial cable, said first pin end receiving an electrical signal from the conductor of the coaxial cable, and having a second pin end elastically contacting said printed circuit board conveying to said printed circuit board said signal received from the cable; and an attachment unit secured to said cylindrical body attaching said cylindrical body to a printed circuit board.

* * * * *